United States Patent [19]

Rege

[11] 3,950,871

[45] Apr. 20, 1976

[54] DEVICE FOR CONTAINING INFORMATION BEARING ARTICLES

[75] Inventor: Nils Rege, Hoganas, Sweden

[73] Assignee: Esselte Obergs AB, Stockholm, Sweden

[22] Filed: June 25, 1974

[21] Appl. No.: 482,702

[52] U.S. Cl. ..... 40/67; 40/78

[51] Int. Cl.[2] ..... G09F 11/06

[58] Field of Search ..... 40/67, 78, 78.03, 78.05, 40/65; 206/387; 312/202, 197; 220/1 A; 402/48, 77

[56] References Cited

UNITED STATES PATENTS

| | | | |
|---|---|---|---|
| 2,994,298 | 8/1961 | Thomas | 40/67 X |
| 3,188,157 | 6/1965 | Rand | 312/202 |
| 3,279,109 | 10/1966 | Whittum | 40/67 X |

*Primary Examiner*—John H. Wolff

*Attorney, Agent, or Firm*—Lowe, King, Price & Markva

[57] ABSTRACT

A cassette device contains information bearing articles and includes two substantially flat cover portions mounted to pivot with respect to each other about an axis of rotation. A means projects outwardly from each cover portion toward the other cover portion and each said projecting means is interconnected with respect to each other at the axis of rotation thereby providing a pivot joint for the cover portion. Edge protecting means extend substantially perpendicularly from each cover portion. Each of the edge protecting means is disposed along a complementary peripheral section of each cover portion so that the device is substantially enclosed around the information bearing articles when the cover portions are registered with respect to each other.

10 Claims, 2 Drawing Figures

DEVICE FOR CONTAINING INFORMATION BEARING ARTICLES

A cassette book or device is an aid to be used especially for selling and marketing and also for educational purposes. This appliance represents a simple and easily understandable aid to supply knowledge and information about special subjects.

The inventor has with this appliance improved and facilitated activities of the above mentioned kind and introduced a complement to the earlier used aids on the market. Thanks to this appliance the possibilities of disseminating information are improved by a handier material than brochures and information prints, and it is cheaper and more durable than bound books. The information cards, which are removable and exchangeable, can be printed separately and thus be combined in a lot of ways and produced in different languages.

The brochure material of the type distributed today is certainly educational but difficult to change, when necessary, at reasonable costs. Besides, it is difficult to read, for which reason the reader very easily overlooks essential things that could have increased the interest in the product advertised.

At teaching, a lot of different ways of giving information have been tried with different results. The material has often a tendency to be too comprehensive and complicated, for which reason both the teacher and the pupils get tired of this kind of aids.

PURPOSE OF THE INVENTION

The primary object of this invention is to provide a cassette device which will substantially eliminate any of the advantages associated with prior art methods of disseminating information.

Another object of this invention is to provide a cassette device which has a simple construction and form and stimulates the interest in the content that is logically assembled therein.

A further object of this invention is to provide a cassette device having an appropriate dimension and design so that it may be easily kept in the pocket of the user.

A further object of the invention is to provide a cassette device having a casing composed of a transparent material so that it is possible to apply address cards in the cover.

A still further object of this invention is to provide a cassette device wherein information bearing articles are easily exchanged for the purpose of maintaining the content of the information up to date.

SUMMARY OF THE INVENTION

These objects and other advantages are associated with the cassette device as disclosed herein. The device includes two substantially flat cover portions mounted to pivot with respect to each other about an axis of rotation. Projections extend outwardly from each cover portion toward the other portion and are interconnected with respect to each other at the axis of rotation thereby providing a pivot point for the cover portions. Edge protecting means extend substantially perpendicularly from each cover portion and are disposed along complementary peripheral sections of each cover portion so that the device is substantially enclosed around the information bearing articles when the cover portions are registered with respect to each other. In one feature of the invention, the projections are placed eccentrically at the periphery of the cover portion so that the information bearing articles are exposed when the cover portions are rotated with respect to each other about the axis of rotation. The information bearing articles are constructed in such a manner that they also rotate about the axis of rotation and may be easily removed from the cassette device.

In a specific embodiment of the invention, the cover portions are rectangular and have the same size with respect to each other. The projections are located at the corner of the cover portions and comprise sleeve members having a size and shape effective to fit together for forming the pivot joint. A quick coupling means is disposed at the pivot joint to provide a detachable connection between the cover portions. The information bearing articles are card members having substantially the same shape of the cover members and the edge protecting means comprise peripheral wall sections which are adjacent the edges of the cards when the cover portions are registered with respect to each other.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
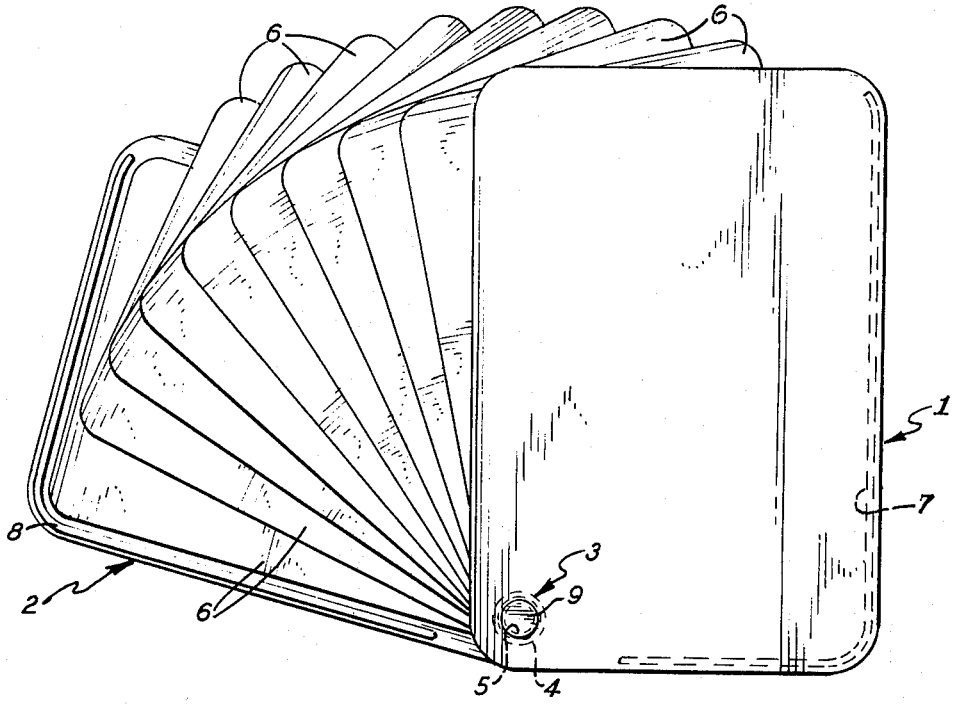
FIG. 1 is a top plan view showing the cassette device having the cover portions rotated with respect to each other so that the different information cards are visible.
Figure 2:
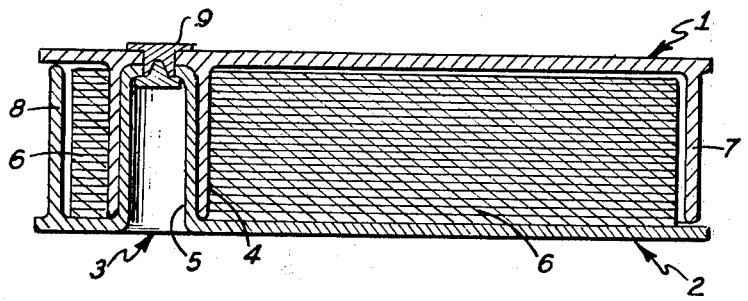
FIG. 2 is a cross-sectional view of the cassette device through the pivot joint around which the two cover portions are rotated.

More specifically, referring to the drawings, the cassette device includes two cover portions 1 and 2 which are mounted to rotate with respect to each other around the pivot joint 3. Sleeve members 4 and 5 project outwardly from the cover portions 1 and 2, respectively. The sleeve members 4 and 5 have a size and a shape effective to fit together for forming the pivot joint 3. A quick coupling means comprising a push-button 9 is used to detachably connect the cover portions 1 and 2 at the pivot joint as shown in FIG. 2.

Card members constitute information bearing articles having holes through which the pivot joint 3 extends to hold the cards between the cover portions 1 and 2. In this specific embodiment, the information cards have substantially the same shape of the cover portions or members 1 and 2. Side edge protecting means comprise peripheral wall sections 7 and 8 which extend substantially perpendicularly from cover members 1 and 2, respectively. The peripheral wall sections 7 and 8 are adjacent the edges of the cards 6 when the cover portions 1 and 2 are registered with respect to each other. Thus, the edges of the information cards are protected when the device is not in use. As shown, the cover portions 1 and 2 are rectangular and have the same size with respect to each other. The sleeve members 4 and 5 are located at the corner of the cover portions 1 and 2, respectively. Each protecting side edge wall section 7 and 8 extend along one short side and one long side of each cover portion 1 and 2, respectively. That is, the side edge wall sections 7 and 8 are disposed along complementary peripheral sections of each cover portion 1 and 2 so that the device is substantially enclosed around the information cards 6 when the cover portions 1 and 2 are registered with respect to each other.

The quick coupling function of the device as shown in this specific embodiment makes it possible for the cover members 1 and 2 to be parted with respect to each other without having the information cards 6 falling out of their position. These cards have holes in them which are disposed around the pivot joint 3.

While the device for containing information bearing devices has been shown and described in detail, it is obvious that this invention is not to be considered as being limited to the exact form disclosed, and that changes in detail and construction may be made therein within the scope of the invention, without departing from the spirit thereof.

I claim:

1. A cassette device for containing information bearing articles, said device comprising:

a. two substantially flat cover portions mounted to pivot with respect to each other about an axis of rotation that is normal to said cover portions and the information bearing articles being disposed between the cover portions, b. means projecting outwardly from each cover portion toward the other cover portion, c. each said projecting means being eccentrically located on the cover portions and interconnected with respect to each other and said information bearing articles at said axis of rotation thereby providing a pivot joint for the cover portions, d. edge protecting means extending substantially perpendicularly from each cover portion toward the other cover portion to protect the edges of the information bearing articles, e. each said edge protecting means including a first wall section extending along a first peripheral section of one cover portion and a second wall section extending along a second peripheral section of the other cover portion, f. said first peripheral wall section being in complementary relationship with respect to said second peripheral wall section to substantially enclose the information bearing articles when the cover portions are registered with respect to each other, g. said peripheral wall sections being at different non-overlapping locations around the periphery of the device whereby the information bearing articles may be selectively pivoted about said pivot joint, h. said cover portions being rectangular and having the same size with respect to each other.

2. A device as defined in claim 1 wherein:

the projecting means are placed eccentrically at the periphery of the cover portions so that the information bearing articles are exposed when the cover portions are rotated with respect to each other about the axis of rotation.

3. A device as defined in claim 2 wherein:

each of the information bearing articles has a hole through which the projecting means extend to hold said articles between the cover portions.

4. A device as defined in claim 1 wherein:

each projecting means comprises a sleeve member, each said sleeve member having a size and shape effective to fit together for forming the pivot joint.

5. A device as defined in claim 4 wherein:

a quick coupling means is disposed at the pivot joint to provide a detachable connection between the cover portion.

6. A device as defined in claim 1 wherein:

said projecting means being located at a corner of the cover portions and each said wall section extends along one short side and one long side of each cover portion thereby enclosing the information bearing articles.

7. A device as defined in claim 6 wherein:

the information bearing articles are card members having substantially the same shape as the cover portions, the peripheral wall sections are adjacent the edges of the cards when the cover portions are registered with respect to each other.

8. A device as defined in claim 1 wherein:

each of the projecting means is attached to a respective cover portion and detachably interconnected with respect to each other.

9. A device as defined in claim 8 wherein:

the information bearing articles are card members having openings through which the projecting means are removably disposed, the peripheral wall sections are adjacent the edges of the cards when the cover portions are registered with respect to each other.

10. A device as defined in claim 1 wherein:

the cover portions are composed of transparent material.

* * * * *